US012258972B2

(12) United States Patent
Pan

(10) Patent No.: US 12,258,972 B2
(45) Date of Patent: Mar. 25, 2025

(54) ABNORMALITY EARLY-WARNING METHOD AND APPARATUS FOR FAN, AND DEVICE AND MEDIUM

(71) Applicant: INSPUR (BEIJING) ELECTRONIC INFORMATION INDUSTRY CO., LTD., Beijing (CN)

(72) Inventor: Hsinyu Pan, Beijing (CN)

(73) Assignee: INSPUR (BEIJING) ELECTRONIC INFORMATION INDUSTRY CO., LTD., Beijing (CN)

( * ) Notice: Subject to any disclaimer, the term of this patent is extended or adjusted under 35 U.S.C. 154(b) by 0 days.

(21) Appl. No.: 18/697,434

(22) PCT Filed: Jun. 30, 2022

(86) PCT No.: PCT/CN2022/102732
§ 371 (c)(1),
(2) Date: Mar. 29, 2024

(87) PCT Pub. No.: WO2023/123958
PCT Pub. Date: Jul. 6, 2023

(65) Prior Publication Data

US 2024/0401598 A1 Dec. 5, 2024

(30) Foreign Application Priority Data

Dec. 31, 2021 (CN) ..... 202111678579.3

(51) Int. Cl.
*F04D 27/00* (2006.01)
*F04D 25/08* (2006.01)

(52) U.S. Cl.
CPC ..... *F04D 27/00* (2013.01); *F04D 25/08* (2013.01)

(58) Field of Classification Search
CPC ..... F04D 27/00; F04D 27/001; F04D 27/004; G06F 1/206
See application file for complete search history.

(56) References Cited

U.S. PATENT DOCUMENTS

2014/0205464 A1 7/2014 Vohlgemuth
2014/0247038 A1 9/2014 Wu
(Continued)

FOREIGN PATENT DOCUMENTS

CN 101211304 A 7/2008
CN 101328901 A 12/2008
(Continued)

OTHER PUBLICATIONS

International Search Report and Written Opinion received for PCT Application No. PCT/CN2022/102732 on Oct. 10, 2022, 10 pgs.
(Continued)

*Primary Examiner* — Justin D Seabe
*Assistant Examiner* — Jackson N Gillenwaters
(74) *Attorney, Agent, or Firm* — Merchant & Gould P.C.

(57) ABSTRACT

An abnormality early-warning method for a fan includes: when a target fan is capable of normally dissipate heat, obtaining a target rotational speed, a target operating current, and a target ambient temperature of the target fan at a current moment; when the target rotational speed is less than a minimum rotational speed of the target fan, providing first early-warning information as a prompt; when the target rotational speed is greater than or equal to the minimum rotational speed of the target fan, predicting a rotational speed and an operating current of the target fan at a next moment based on a rotational speed change curve, a current change curve, the target rotational speed, the target operating current, and the target ambient temperature to obtain a predicted rotational speed and a predicted operating current;
(Continued)

and when the predicted rotational speed is less than a first preset threshold or the predicted operating current is greater than a second preset threshold, providing second early-warning information as a prompt. The present disclosure further relates to an abnormality early-warning apparatus and device for a fan, and a medium.

20 Claims, 5 Drawing Sheets

(56) References Cited

U.S. PATENT DOCUMENTS

| | | | | |
|---|---|---|---|---|
| 2015/0378403 | A1* | 12/2015 | Chen | H05K 7/20209 700/282 |
| 2019/0191592 | A1* | 6/2019 | Liu | F04D 27/004 |

FOREIGN PATENT DOCUMENTS

| | | | | | |
|---|---|---|---|---|---|
| CN | 102758787 | A | * | 10/2012 | |
| CN | 103133371 | A | | 6/2013 | |
| CN | 105715569 | A | | 6/2016 | |
| CN | 106438428 | A | | 2/2017 | |
| CN | 109763992 | A | | 5/2019 | |
| CN | 110006014 | A | * | 7/2019 | F21V 29/61 |
| CN | 110154821 | A | | 8/2019 | |
| CN | 110345099 | A | | 10/2019 | |
| CN | 110778517 | A | | 2/2020 | |
| CN | 111382519 | A | | 7/2020 | |
| CN | 111749781 | A | | 10/2020 | |
| CN | 113534936 | A | | 10/2021 | |
| CN | 114320970 | A | | 4/2022 | |

OTHER PUBLICATIONS

Chinese Search Report received for CN Application No. 2021116785793, 3 pgs.

* cited by examiner

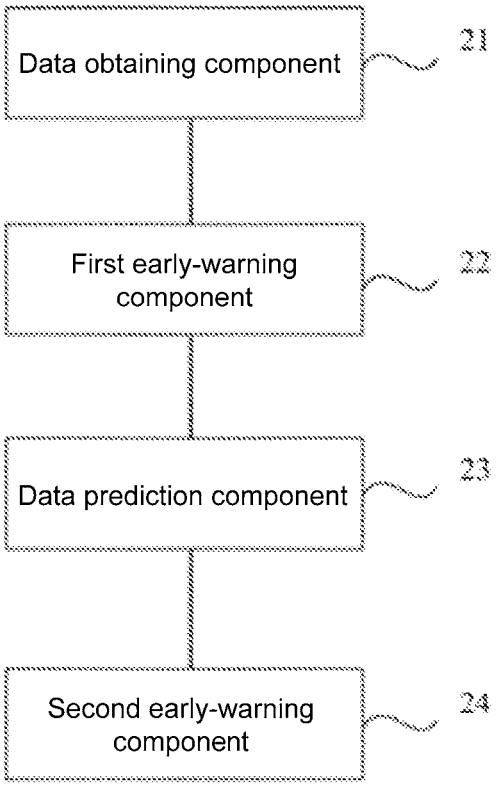
Fig. 7
Fig. 8
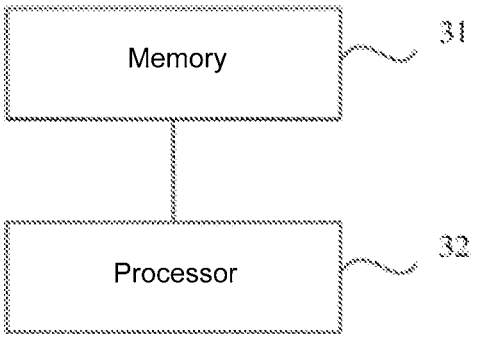

ABNORMALITY EARLY-WARNING METHOD AND APPARATUS FOR FAN, AND DEVICE AND MEDIUM

CROSS-REFERENCE TO RELATED APPLICATION

The present application is a National Stage Application of PCT International Application No.: PCT/CN2022/102732 filed on Jun. 30, 2022, which claims priority to Chinese Patent Application 202111678579.3, filed in the China National Intellectual Property Administration on Dec. 31, 2021, the disclosure of which is incorporated herein by reference in its entirety.

TECHNICAL FIELD

The present disclosure relates to the technical field of servers, in particular to an abnormality early-warning method, apparatus, and device for a fan, and a medium.

BACKGROUND

The inventor realizes that in the related art, people often judge whether a fan is abnormal by judging whether the rotational speed of the fan is lower than a preset rotational speed without considering the abnormality of the fan due to lifetime decay, such that great potential safety hazards are brought to the operation of the fan

SUMMARY

An abnormality early-warning method for a fan includes:

when a target fan is capable of normally dissipating heat, obtaining a target rotational speed, a target operating current, and a target ambient temperature of the target fan at a current moment;

when the target rotational speed is less than a minimum rotational speed of the target fan, providing first early-warning information as a prompt;

when the target rotational speed is greater than or equal to the minimum rotational speed of the target fan, predicting a rotational speed and an operating current of the target fan at a next moment based on a rotational speed change curve, a current change curve, the target rotational speed, the target operating current, and the target ambient temperature to obtain a predicted rotational speed and a predicted operating current; and when the predicted rotational speed is less than a first preset threshold or the predicted operating current is greater than a second preset threshold, providing second early-warning information as a prompt, where the first preset threshold and the second preset threshold are numerical values set based on the IPC9591 standard.

In some embodiments, the process of obtaining a target rotational speed, a target operating current, and a target ambient temperature of the target fan at a current moment includes:

obtaining the target rotational speed, the target operating current, and the target ambient temperature of the target fan at the current moment by using a baseboard management controller (BMC).

In some embodiments, the process of obtaining the rotational speed change curve and the current change curve includes:

obtaining historical rotational speeds and historical operating currents of the target fan at different ambient temperatures, and obtaining rotational speed change rates and operating current change rates of the target fan that are changed with time at the different ambient temperatures respectively based on the historical rotational speeds and the historical operating currents, to obtain the rotational speed change curve and the current change curve.

In some embodiments, the process of obtaining historical rotational speeds and historical operating currents of the target fan at different ambient temperatures, and obtaining rotational speed change rates and operating current change rates of the target fan that are changed with time at the different ambient temperatures respectively based on the historical rotational speeds and the historical operating currents includes:

monitoring rotational speeds and operating currents of the target fan at different ambient temperatures;

storing the rotational speeds and the operating currents of the target fan in a first storage area, and determining rotational speed changes and operating current changes of the target fan that are changed with time at the different ambient temperatures based on the rotational speeds and the operating currents of the target fan, to obtain a first data set;

storing the first data set in a third storage area;

when a duration at which data is stored in the first storage area reaches a preset duration threshold, storing the rotational speeds and the operating currents of the target fan in a second storage area, and determining rotational speed changes and operating current changes of the target fan that are changed with time at the different ambient temperatures based on the rotational speeds and the operating currents of the target fan, to obtain a second data set;

storing the second data set in the third storage area;

when all data in the first data set is written into the third storage area, clearing the data in the first storage area, and when all data in the second data set is written into the third storage area, clearing data in the second storage area;

when a duration at which the data is stored in the second storage area reaches the preset duration threshold, repeatedly performing the step of storing the rotational speeds and the operating currents of the target fan in a first storage area, and determining rotational speed changes and operating current changes of the target fan that are changed with time at the different ambient temperatures based on the rotational speeds and the operating currents of the target fan, to obtain a first data set; and when an amount of the data stored in the third storage area reaches a preset storage amount, obtaining the rotational speed change rates and the operating current change rates of the target fan that are changed with the time at the different ambient temperatures based on all the data in the third storage area.

In some embodiments, the process of determining rotational speed changes and operating current changes of the target fan that are changed with time at the different ambient temperatures based on the rotational speeds and the operating currents of the target fan includes:

sending the rotational speeds and the operating currents of the target fan to a target logic operation chip, and determining the rotational speed changes and the operating current changes of the target fan that are changed with the time at the different ambient temperatures by using the target logic operation chip.

In some embodiments, the target logic operation chip is specifically a microcontroller unit (MCU) or a digital signal processor (DSP).

In some embodiments, the method further includes:

predicting a service life of the target fan based on the rotational speed change curve, the current change curve, the target rotational speed, the target operating current, and the target ambient temperature to obtain a predicted service duration.

In some embodiments, the process of predicting a service life of the target fan based on the rotational speed change curve, the current change curve, the target rotational speed, the target operating current, and the target ambient temperature to obtain a predicted service duration includes:

determining an initial rotational speed of the target fan in an initial operating state based on the rotational speed change curve, and determining the rotational speed of the target fan at the next moment based on the rotational speed change curve, the target ambient temperature, and the target rotational speed, to obtain the predicted rotational speed;

when the predicted rotational speed reaches the first preset threshold, obtaining an operating duration of the target fan when operating from the initial rotational speed to the first preset threshold, to obtain a first service duration;

determining an initial operating current of the target fan in the initial state based on the current change curve, and determining the operating current of the target fan at the next moment based on the current change curve, the target ambient temperature, and the target operating current, to obtain the predicted operating current;

when the predicted operating current reaches the second preset threshold, obtaining an operating duration of the target fan when operating from the initial operating current to the second preset threshold, to obtain a second service duration; and determining a shorter one of the first service duration and the second service duration as the predicted service duration.

In some embodiments, the method further includes:

obtaining a service duration of the target fan that is marked when leaving the factory, to obtain a reference service duration; and correcting the reference service duration with the predicted service duration.

The present disclosure further discloses an abnormality early-warning apparatus for a fan, includes:

a data obtaining component configured to obtain, when a target fan is capable of normally dissipating heat, a target rotational speed, a target operating current, and a target ambient temperature of the target fan at a current moment;

a first early-warning component configured to provide, when the target rotational speed is less than a minimum rotational speed of the target fan, first early-warning information as a prompt;

a data prediction component configured to predict, when the target rotational speed is greater than or equal to the minimum rotational speed of the target fan, a rotational speed and an operating current of the target fan at a next moment based on a rotational speed change curve, a current change curve, the target rotational speed, the target operating current, and the target ambient temperature to obtain a predicted rotational speed and a predicted operating current; and a second early-warning component configured to provide, when the predicted rotational speed is less than a first preset threshold or the predicted operating current is greater than a second preset threshold, second early-warning information as a prompt, where the first preset threshold and the second preset threshold are numerical values set based on the IPC9591 standard.

The embodiments of the present disclosure further disclose an abnormality early-warning device for a fan, including a memory and one or more processors, where the memory stores a computer-readable instruction which, when executed by the one or more processors, causes the one or more processors to perform the steps of any one of the above abnormality early-warning methods for a fan.

The embodiments of the present disclosure further discloses one or more non-transitory computer-readable storage media storing computer-readable instructions, where the computer-readable instructions, when executed by one or more processors, cause the one or more processors to perform the steps of any one of the above abnormality early-warning methods for a fan.

BRIEF DESCRIPTION OF THE DRAWINGS

To more clearly describe the technical solutions in the embodiments of the present disclosure or in the related art, the accompanying drawings that need to be used in the description of the embodiments or the related art will be briefly described below. Apparently, the accompanying drawings in the description below merely illustrate the embodiments of the present disclosure. Those of ordinary skill in the art may also derive other accompanying drawings from the provided accompanying drawings without creative efforts.

FIG. 7 is a structural diagram of an abnormality early-warning apparatus for a fan provided by one or more embodiments of the present disclosure; and FIG. 8 is a structural diagram of an abnormality early-warning device for a fan provided by one or more embodiments of the present disclosure.

DETAILED DESCRIPTION OF THE EMBODIMENTS

The technical solutions in the embodiments of the present disclosure are clearly and completely described below with reference to the accompanying drawings in the embodiments of the present disclosure. Apparently, the described embodiments are merely some rather than all of the embodiments of the present disclosure. All other embodiments obtained by those of ordinary skill in the art based on the embodiments of the present disclosure without creative efforts shall fall within the scope of protection of the present disclosure.

Figure 1:
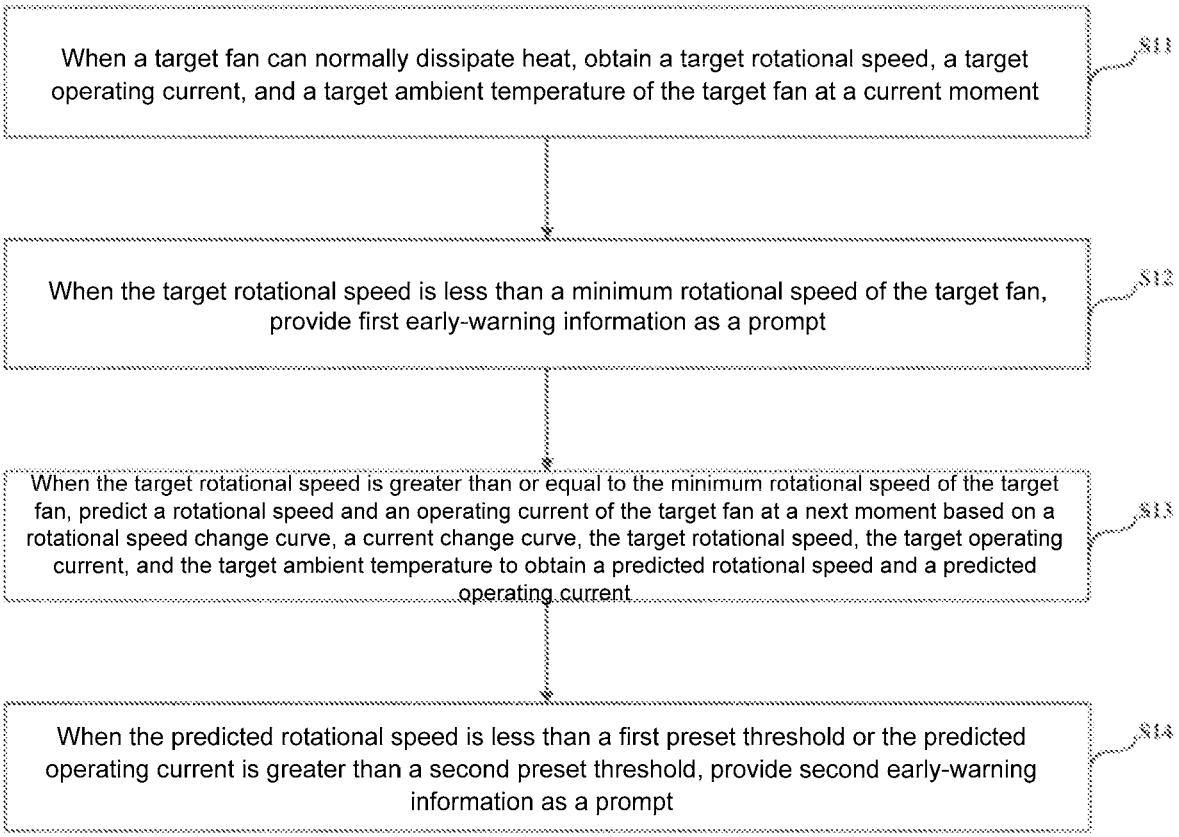
FIG. 1 is a flowchart of an abnormality early-warning method for a fan provided by one or more embodiments of the present disclosure.

Reference is made to FIG. 1. FIG. 1 is a flowchart of an abnormality early-warning method for a fan provided by an embodiment of the present disclosure. An example where the method is applied to an abnormality early-warning device for a fan is provided for description. The method includes:

step S11: when a target fan is capable of normally dissipating heat, obtaining a target rotational speed, a target operating current, and a target ambient temperature of the target fan at a current moment;

step S12: when the target rotational speed is less than a minimum rotational speed of the target fan, providing first early-warning information as a prompt;

step S13: when the target rotational speed is greater than or equal to the minimum rotational speed of the target fan, predicting a rotational speed and an operating current of the target fan at a next moment based on a rotational speed change curve, a current change curve, the target rotational speed, the target operating current, and the target ambient temperature to obtain a predicted rotational speed and a predicted operating current; and step S14: when the predicted rotational speed is less than a first preset threshold or the predicted operating current is greater than a second preset threshold, providing second early-warning information as a prompt, where the first preset threshold and the second preset threshold are numerical values set based on the IPC9591 standard.

In the embodiments of the present disclosure, the abnormality early-warning method for a fan is provided. By using the method, abnormal behaviors generated by the fan during operation may be determined more timely, and the safety of the fan during operation can be improved.

In the method, first, when the fan may normally dissipate heat, the target rotational speed, the target operating current, and the target ambient temperature of the target fan at the current moment are obtained. Because a normal operation state of the target fan is closely related to a rotational speed of the fan, when the target rotational speed of the target fan at the current moment is less than the minimum rotational speed of the target fan, it indicates that the target fan is abnormal. In this case, the first early-warning information needs to be provided as a prompt for a staff, such that the staff may repair and replace the target fan.

When the target rotational speed of the target fan at the current moment is greater than or equal to the minimum rotational speed of the target fan, it indicates that the problem of the target fan may not be found from the rotational speed of the target fan. In this case, in order to further find out potential safety hazards of the target fan, it is required to predict the rotational speed and the operating current of the target fan at the next moment based on the rotational speed change curve, the current change curve, and the target rotational speed, the target operating current, and the target ambient temperature of the target fan at the current moment to obtain the predicted rotational speed and the predicted operating current of the target fan at the next moment.

It should be noted that in the embodiments, the rotational speed change curve refers to a curve in which an operating speed of the target fan changes with time from an initial operating state at different ambient temperatures, and the current change curve refers to a curve in which an operating current of the target fan changes with the time from the initial operating state at the different ambient temperatures. Because the rotational speed and the operating current of the target fan will change greatly at the different ambient temperatures, when the rotational speed change curve and the current change curve are obtained, it is required to obtain the curves of the rotational speed and the operating current of the target fan that are changed with the time from the initial operating state at the different ambient temperatures.

It may be understood that since the target fan is a lossy device and its physical performance will be irreversibly degraded with the increase of the service duration of the target fan, the predicted rotational speed of the target fan at the next moment may be inferred based on the rotational speed change curve of the target fan and the target ambient temperature and the target rotational speed of the target fan at the current moment. Similarly, the predicted operating current of the target fan at the next moment may be inferred based on the current change curve of the target fan and the target ambient temperature and the target operating current of the target fan at the current moment.

Because the IPC9591 standard is a determination standard provided by the international institute of printed circuits (IPC) for reliable operation and life prediction of fans, a rotational speed limit and an operating current limit of the target fan due to lifetime decay may be obtained based on the IPC9591 standard.

In some embodiments, the rotational speed limit of the target fan due to the lifetime decay is set as a first preset threshold, and the operating current limit of the target fan due to the lifetime decay is set as a second preset threshold. During actual operation, based on the IPC9591 standard, the first preset threshold may be set to be lower than 15% of the corresponding rotational speed of the target fan in the initial state, and the second preset threshold may be set to be higher than 15% of the corresponding operating current of the target fan in the initial state. That is, when it is determined that the rotational speed of the target fan is less than the first preset threshold, or when it is determined that the operating current of the target fan is greater than the second preset threshold, it indicates that the service life of the target fan has reached a limit state, and the target fan needs to be replaced or repaired.

In other words, when it is determined that the predicted rotational speed of the target fan at the next moment is less than the first preset threshold, it indicates that the target rotational speed of the target fan at the current moment has been close to the limit state of the service life of the target fan, and the second early-warning information needs to be provided as a prompt to remind the staff to pay attention. Alternatively, when it is determined that the predicted operating current of the target fan at the next moment is greater than the second preset threshold, it indicates that the target operating current of the target fan at the current moment has been close to the limit state of the service life of the target fan, and the second early-warning information needs to be provided as a prompt to remind the staff to pay attention.

Obviously, in addition to determining the abnormal behaviors of the target fan by using the minimum rotational speed of the target fan, the method predicts an operating state of the target fan at the next moment based on the target rotational speed, the target operating current, and the target ambient temperature of the target fan at the current moment, and evaluates a decay degree of the service life of the target fan based on a predicted result. In such a way, more abnormal behaviors of the target fan during operation may be found out, which may further improve the safety of the target fan during the operation. Moreover, the method is applicable to all systems with fans as radiators.

It may be seen that in the embodiments, when the target fan may normally dissipate heat, the target rotational speed, the target operating current, and the target ambient temperature of the target fan at the current moment are obtained first; when the target rotational speed is less than the minimum rotational speed of the target fan, the first early-warning information is provided as a prompt; when the target rotational speed is greater than or equal to the minimum rotational speed of the target fan, the rotational speed and the operating current of the target fan at the next moment are predicted based on the rotational speed change curve, the current change curve, the target rotational speed, the target operating current, and the target ambient temperature to obtain the predicted rotational speed and the predicted operating current; and when the predicted rotational speed of the target fan at the next moment is less than the first preset threshold or the predicted operating current of the target fan at the next moment is greater than the second preset threshold, the second early-warning information is provided as a prompt. Compared with the related art, in addition to determining the abnormal behaviors of the target fan by using the minimum rotational speed of the target fan, the method predicts the operating state of the target fan at the next moment based on the target rotational speed, the target operating current, and the target ambient temperature of the target fan at the current moment, and evaluates the decay degree of the service life of the target fan based on the predicted result. In such a way, more abnormal behaviors of the target fan during operation may be found out, which may further improve the safety of the target fan during the operation.

Based on the above embodiment, this embodiment further illustrates and optimizes the technical solution. In some embodiments, the above step of obtaining a target rotational speed, a target operating current, and a target ambient temperature of the target fan at a current moment includes:

obtaining the target rotational speed, the target operating current, and the target ambient temperature of the target fan at the current moment by using a BMC.

Fans are usually used to cool large servers and ensure normal operation of them. In a large server, a baseboard management controller (BMC) is basically set as a core controller of an entire system, so in the embodiments, the BMC is used to obtain the target rotational speed, the target operating current, and the target ambient temperature of the target fan at the current moment, in order to reduce the cost of monitoring the target fan.

Figure 2:
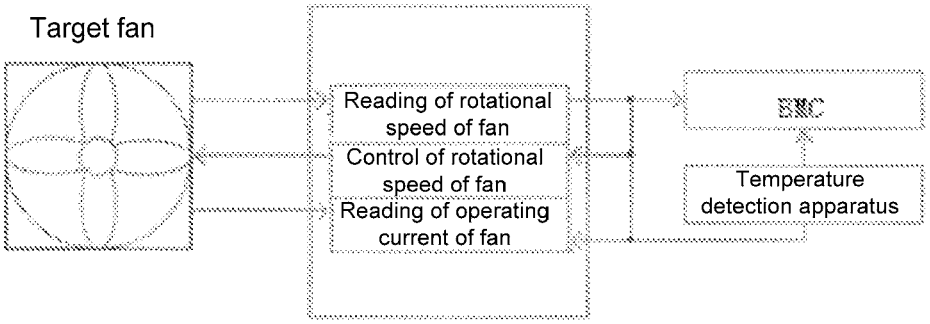
FIG. 2 is a schematic diagram of monitoring a target fan by using a BMC according to one or more embodiments.

Reference is made to FIG. 2. FIG. 2 is a schematic diagram of monitoring a target fan by using a BMC. When the BMC monitors the target fan, the rotational speed and the operating current of the target fan during operation are read on one hand, and the ambient temperature of the target fan is read by a temperature detection apparatus on the other hand.

Based on the above embodiment, this embodiment further illustrates and optimizes the technical solution. In some embodiments, the above step of obtaining the rotational speed change curve and the current change curve includes:

obtaining historical rotational speeds and historical operating currents of the target fan at different ambient temperatures, and obtaining rotational speed change rates and operating current change rates of the target fan that are changed with time at the different ambient temperatures respectively based on the historical rotational speeds and the historical operating currents, to obtain the rotational speed change curve and the current change curve.

Because the historical rotational speeds and the historical operating currents of the target fan at the different ambient temperatures may represent the operating performance of the target fan in a historical operating state, the rotational speed change curve and the operating current change curve of the target fan that are changed with the time at the different ambient temperatures may be obtained based on the historical rotational speeds and the historical operating currents of the target fan.

Figure 3:
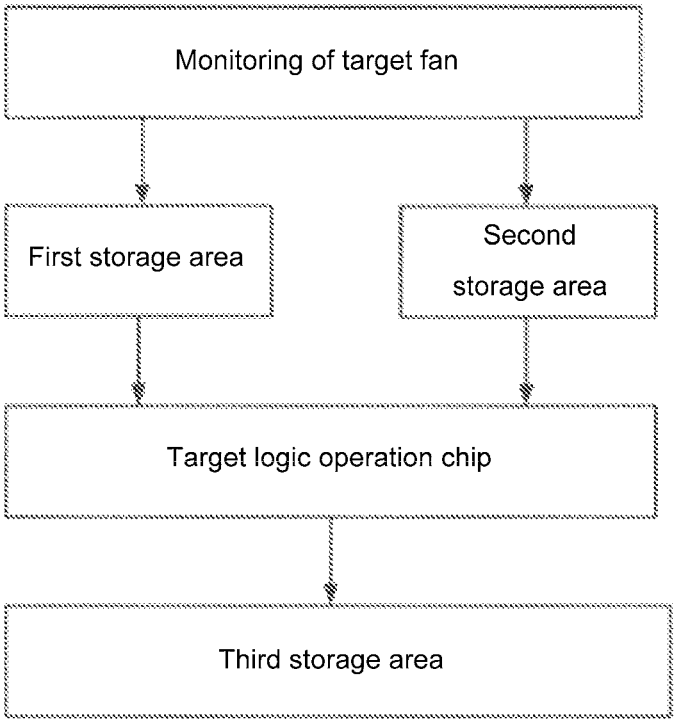
FIG. 3 is a schematic diagram of processing monitored data of a target fan provided by one or more embodiments of the present disclosure.
Figure 4:
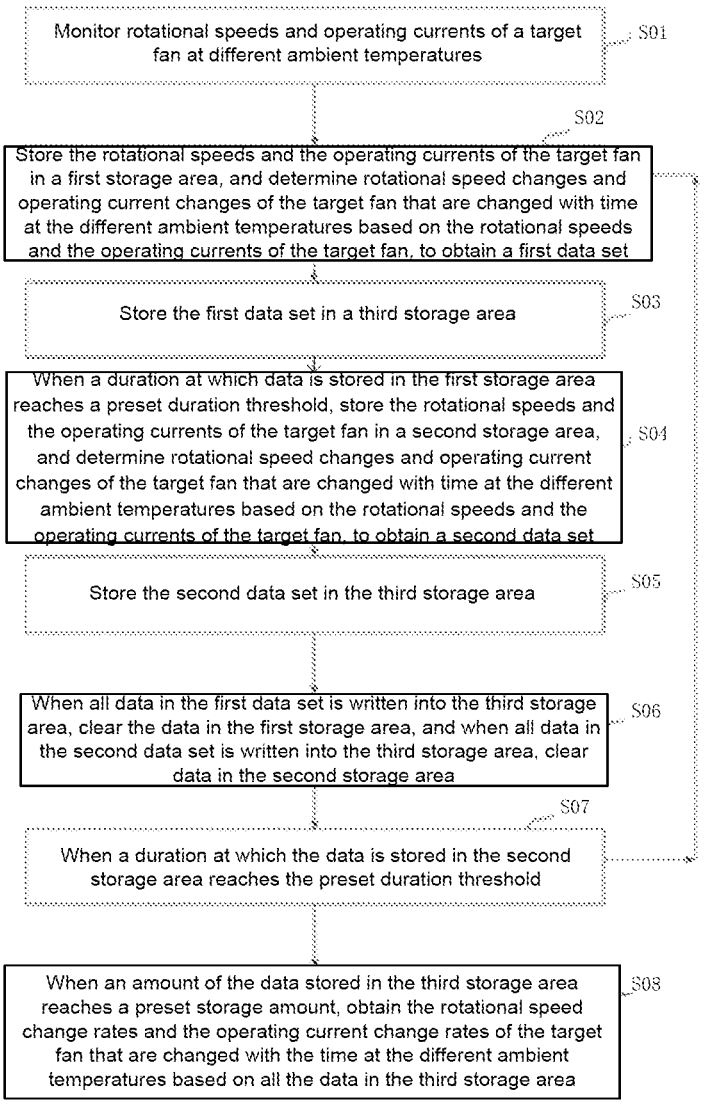
FIG. 4 is a flowchart of obtaining rotational speed change rates and operating current change rates of a target fan that are changed with time at different ambient temperatures provided according to one or more embodiments of the present disclosure.

Reference is made to FIG. 3 and FIG. 4, where FIG. 3 is a schematic diagram of processing monitored data of a target fan provided by an embodiment of the present disclosure, and FIG. 4 is a flowchart of obtaining rotational speed change rates and operating current change rates of a target fan that are changed with time at different ambient temperatures provided by an embodiment of the present disclosure. In some embodiments, the above step of obtaining historical rotational speeds and historical operating currents of the target fan at different ambient temperatures, and obtaining rotational speed change rates and operating current change rates of the target fan that are changed with time at the different ambient temperatures respectively based on the historical rotational speeds and the historical operating currents includes:

step S01: monitoring rotational speeds and operating currents of the target fan at different ambient temperatures;

step S02: storing the rotational speeds and the operating currents of the target fan in a first storage area, and determining rotational speed changes and operating current changes of the target fan that are changed with time at the different ambient temperatures based on the rotational speeds and the operating currents of the target fan, to obtain a first data set;

step S03: storing the first data set in a third storage area;

step S04: when a duration at which data is stored in the first storage area reaches a preset duration threshold, storing the rotational speeds and the operating currents of the target fan in a second storage area, and determining rotational speed changes and operating current changes of the target fan that are changed with time at the different ambient temperatures based on the rotational speeds and the operating currents of the target fan, to obtain a second data set;

step S05: storing the second data set in the third storage area;

step S06: when all data in the first data set is written into the third storage area, clearing the data in the first storage area, and when all data in the second data set is written into the third storage area, clearing data in the second storage area;

step S07: when a duration at which the data is stored in the second storage area reaches the preset duration threshold, repeatedly performing the step S02; and step S08: when an amount of the data stored in the third storage area reaches a preset storage amount, obtaining the rotational speed change rates and the operating current change rates of the target fan that are changed with the duration at the different ambient temperatures based on all the data in the third storage area.

In the embodiments, in order to ensure the accuracy and reliability of the obtained rotational speed change curve and current change curve, three storage areas are used to store the historical rotational speeds and the historical operating currents of the target fan at the different ambient temperatures.

In some embodiments, when the rotational speeds and the operating currents of the target fan are monitored, the rotational speeds and the operating currents of the target fan at the different ambient temperatures are first stored in the first storage area, and then the rotational speed changes and the operating current changes of the target fan that are changed with the time at the different ambient temperatures are determined based on the rotational speeds and the operating currents of the target fan, to obtain the first data set. When the first data set is obtained through calculation, it is required to store the first data set in the third storage area.

determining the rotational speed changes and the operating current changes of the target fan that are changed with the time at the different ambient temperatures by using the target logic operation chip.

In the embodiments, in order to increase the speed of calculating the rotational speed changes and the operating current changes of the target fan that are changed with the time at the different ambient temperatures, the rotational speeds and the operating currents of the target fan are directly sent to the target logic operation chip after being obtained, and the rotational speed changes and the operating current changes of the target fan that are changed with the time at the different ambient temperatures are calculated by using the target logic operation chip. Reference is made to Table 1. Table 1 shows rotational speeds and operating currents of a target fan at a moment 1 and a moment 2.

TABLE 1

| Temperature | Fan speed (RPM) | | | | Operating current (Amp) | | | |
|---|---|---|---|---|---|---|---|---|
| | Upper limit | | Lower limit | | Upper limit | | Lower limit | |
| (° C.) | Moment | Moment 2 | Moment 1 | Momen | Moment | Moment 2 | Moment | Moment |
| 30 | 23000 | 22980 | 22800 | 22780 | 2.0 | 2.02 | 1.97 | 1.99 |
| 31 | 24000 | 23980 | 23800 | 23780 | 2.1 | 2.14 | 2.07 | 2.11 |
| 32 | 25000 | 24908 | 24800 | 24780 | 2.2 | 2.26 | 2.17 | 2.23 |

When the duration at which the data is stored in the first storage area reaches the preset duration threshold, the monitored rotational speeds and operating currents of the target fan at the different ambient temperatures are stored in the second storage area, and the rotational speed changes and the operating current changes of the target fan that are changed with the time at the different ambient temperatures are determined based on the rotational speeds and the operating currents of the target fan, to obtain the second data set. When the second data set is obtained, it is required to store the second data set in the third storage area.

Meanwhile, when all the data in the first data set is written into the third storage area, the data in the first storage area is cleared. When the duration at which the data is stored in the second storage area reaches the preset duration threshold, the step S02 is repeatedly performed, that is, the monitored rotational speeds and operating currents of the target fan are again stored in the first storage area. Moreover, when all the data in the second data set is written into the third storage area, the data in the second storage area is cleared. In such a way, the monitored data of the target fan is repeatedly and alternately stored and processed by using the first storage area and the second storage area, which not only may ensure the continuous storage of the monitored data of the target fan, but also saves the occupation of storage resources.

When the amount of the data stored in the third storage area reaches the preset storage amount, the rotational speed change rates and the operating current change rates of the target fan that are changed with the time at the different ambient temperatures are obtained based on all the data in the third storage area.

In some embodiments, the above step of determining rotational speed changes and operating current changes of the target fan that are changed with time at the different ambient temperatures based on the rotational speeds and the operating currents of the target fan includes:

sending the rotational speeds and the operating currents of the target fan to a target logic operation chip, and It is conceivable that by recording the rotational speeds and the operating currents of the target fan at the different ambient temperatures and in different time periods, the rotational speed changes and the operating current changes of the target fan in the time periods may be obtained. During actual operation, in order to obtain a rotational speed change of the target fan from a moment 1 to a moment 2, the rotational speed change of the target fan at the moments may be obtained by calculating a difference between rotational speed upper limits or lower limits of the target fan at the moment 2 and the moment 1. Similarly, in order to obtain an operating current change of the target fan from the moment 1 to the moment 2, the operating current change of the target fan at the moments may be obtained by calculating a difference between operating current upper limits or lower limits of the target fan at the moment 2 and the moment 1. In this case, the rotational speed change and the operating current change shown in Table 2 are obtained.

TABLE 2

| Temperature (° C.) | Fan speed (RPM) | | Operating current | |
|---|---|---|---|---|
| | Upper limit | Lower limit | Upper limit | Lower limit |
| 31 | 0.0870% | 0.0877% | 1.0000% | 1.0152% |
| 32 | 0.0833% | 0.0840% | 1.9048% | 1.9324% |
| 33 | 0.0800% | 0.0806% | 2.7273% | 2.7650% |

In some embodiments, the target logic operation chip may be set as a microcontroller unit (MCU) or a digital signal processor (DSP). Because a large number of logic operation units are arranged in the MCU and the DSP, when the MCU or the DSP is used to calculate the rotational speed changes and the operating current changes of the target fan that are changed with the time at the different ambient temperatures, the speed of calculating the rotational speed changes and the operating current changes may be relatively increased.

In some embodiments, the method further includes:

predicting a service life of the target fan based on the rotational speed change curve, the current change curve, the target rotational speed, the target operating current, and the target ambient temperature to obtain a predicted service duration.

It may be understood that because the rotational speed change curve and the current change curve of the target fan represent actual attenuation conditions of the rotational speed and the operating current of the target fan in the initial state, the predicted service duration of the target fan may be predicted based on the rotational speed change curve, the current change curve, and the target rotational speed, the target operating current, and the target ambient temperature of the target fan at the current moment.

In some embodiments, during actual operation, in order to obtain the rotational speed change curve of the target fan, the rotational speeds of the target fan at the different ambient temperatures may be measured within a preset time period when the target fan starts to operate from the initial state, and then, with the operation of the target fan, the measured rotational speeds and the ambient temperatures corresponding to the rotational speeds are plotted as a relation curve graph on corresponding changes of the target fan with operating duration to obtain the rotational speed change curve of the target fan. In some embodiments, in order to obtain the current change curve of the target fan, the operating currents of the target fan at the different ambient temperatures may be measured within the preset time period when the target fan starts to operate from the initial state, and then, with the operation of the target fan, the measured operating currents and the ambient temperatures corresponding to the operating currents are plotted as a relation curve graph on corresponding changes of the target fan with operating duration to obtain the current change curve of the target fan.

In some embodiments, the above step of predicting a service life of the target fan based on the rotational speed change curve, the current change curve, the target rotational speed, the target operating current, and the target ambient temperature to obtain a predicted service duration includes:

determining an initial rotational speed of the target fan in an initial operating state based on the rotational speed change curve, and determining the rotational speed of the target fan at the next moment based on the rotational speed change curve, the target ambient temperature, and the target rotational speed, to obtain the predicted rotational speed;

when the predicted rotational speed reaches the first preset threshold, obtaining an operating duration of the target fan when operating from the initial rotational speed to the first preset threshold, to obtain a first service duration;

determining an initial operating current of the target fan in the initial state based on the current change curve, and determining the operating current of the target fan at the next moment based on the current change curve, the target ambient temperature, and the target operating current, to obtain the predicted operating current;

when the predicted operating current reaches the second preset threshold, obtaining an operating duration of the target fan when operating from the initial operating current to the second preset threshold, to obtain a second service duration; and determining a shorter one of the first service duration and the second service duration as the predicted service duration.

In the process of predicting the predicted service duration of the target fan, the initial rotational speed of the target fan in the initial operating state is first determined based on the rotational speed change curve of the target fan, and the predicted rotational speed of the target fan at the next moment is determined based on the rotational speed change curve and the target ambient temperature and the target rotational speed of the target fan at the current moment. When the predicted rotational speed of the target fan reaches the first preset threshold, it indicates that the service life of the target fan has been close to the limit state, and the predicted service duration, that is, the first service duration, of the target fan may be obtained by calculating the operating duration of the target fan when operating from the initial rotational speed to the first preset threshold.

After the first service duration is obtained, the initial operating current of the target fan in the initial state is determined based on the current change curve, and the operating current of the target fan at the next moment is determined based on the current change curve and the target ambient temperature and the target operating current of the target fan at the current moment, to obtain the predicted operating current. When the predicted operating current of the target fan reaches the second preset threshold, it indicates that the service life of the target fan has been close to the limit state, and the predicted service duration, that is, the second service duration, of the target fan may be obtained by calculating the operating duration of the target fan when operating from the initial operating current to the second preset threshold.

Figure 5:
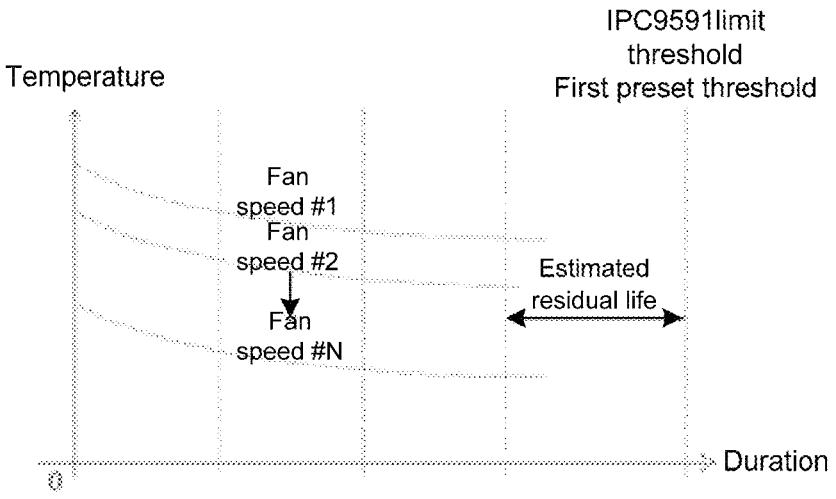
FIG. 5 is a schematic diagram of predicting a service life of a target fan based on a rotational speed change curve according to one or more embodiments.
Figure 6:
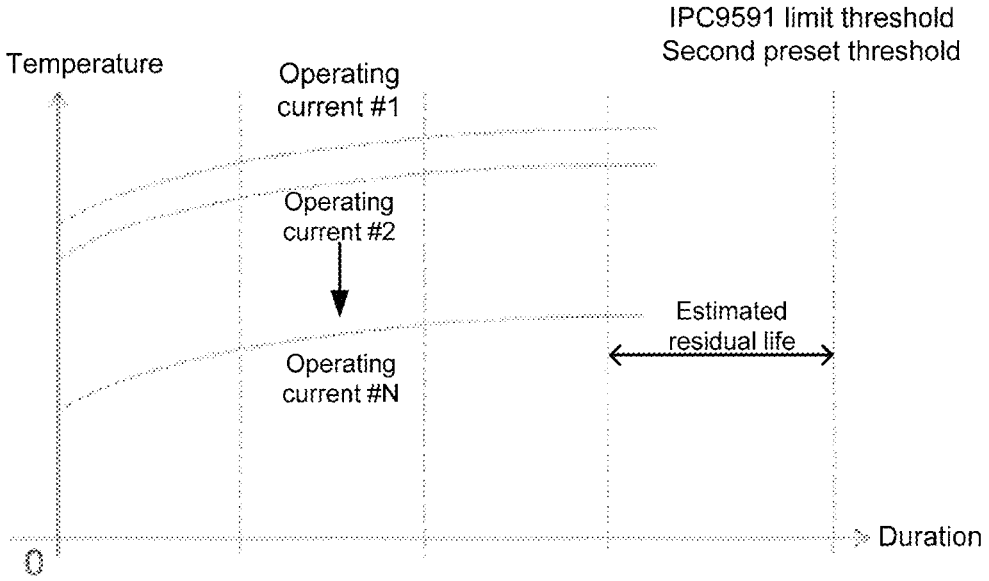
FIG. 6 is a schematic diagram of predicting a service life of a target fan based on a current change curve according to one or more embodiments.

Reference is made to FIG. 5 and FIG. 6. FIG. 5 is a schematic diagram of predicting a service life of a target fan based on a rotational speed change curve. FIG. 6 is a schematic diagram of predicting a service life of a target fan based on a current change curve. Moreover, it may be seen according to the IPC9591 standard that the service life of the target fan is related to the rotational speed, the current, and the noise, so when one of the three parameters of the target fan has a problem, the service life of the target fan will be directly affected. Therefore, in the embodiments, the shorter one of the first service duration and the second service duration is determined as the predicted service duration finally predicted by the target fan.

Alternatively, in practical disclosure, the residual service duration of the target fan may be calculated based on the rotational speed change curve, the target rotational speed and the target ambient temperature of the target fan at the current moment, and the first preset threshold. Similarly, the residual service duration of the target fan may be calculated based on the current change curve, the target operating current and the target ambient temperature of the target fan at the current moment, and the second preset threshold.

In some embodiments, the abnormality early-warning method further includes:

obtaining a service duration of the target fan that is marked when leaving the factory, to obtain a reference service duration; and correcting the reference service duration with the predicted service duration.

In the related art, each fan manufacturer will provide some attribute parameters of the fan. When these attribute parameters are substituted into Weibull distribution (Weibull Shape Parameter), expected lives L10 (Life 10, a duration when a cumulative failure rate reaches 10% after taking a batch of fans for life test) of the fans at different temperatures may be calculated. A mathematical expression for the Weibull distribution is as follows:

$$t = 2.117 \times L_{10} \times [4.605/2n]^{1/\beta} \div (AF^{(T_s - T_u)/10})$$

where t is operating duration of the target fan which is actually tested to be abnormal, $T_s$ is an actual test temperature, $T_u$ is an initial L10 estimated temperature, AF is an acceleration factor, β is a Weibull Shape Parameter, and n is a number of test samples.

TABLE 3

| | L10 (hours) | | Test | | | Duration (hours) for testing |
|---|---|---|---|---|---|---|
| | 40° C. | Test temperature | temperature (° C.) | AF | β | each fan with zero-failure test strategy |
| IPC-9591 | 50000 | 14815 | 70 | 1.5/10° C. | 3 | 10580 |
| Manufacturer | 50000 | 6250 | 85 | 2.0/15° C. | 3 | 4463 |
| Manufacturer | 50000 | 9651 | 75 | 1.6/10° C. | 2.5 | 6443 |
| Manufacturer | 50000 | 3125 | 80 | 2.0/10° C. | 1.1 | 1247 |
| Manufacturer | 50000 | 6250 | 70 | 2.0/10° C. | 1.1 | 2493 |
| Manufacturer E | 50000 | 9877 | 80 | 1.5/10° C. | 2.0 | 5961 |
| Manufacturer F | 50000 | 14815 | 70 | 1.5/10° C. | 2.9 | 10506 |

TABLE 4

| | β | MTTF/L10 |
|---|---|---|
| IPC-9591 and Manufacturer A | 3.0 | 1.89 |
| Manufacturer B | 2.5 | 2.18 |
| Manufacturers C and | 1.1 | 7.47 |
| Manufacturer E | 2.0 | 2.73 |
| Manufacturer F | 2.9 | 1.94 |

Reference is made to Table 3 and Table 4. Table 3 and Table 4 show fan parameters provided by fan manufacturers. It may be seen from Table 3 and Table 4 that since there are huge differences in parameters such as AF, β, and MTTF (Mean Time to Failure) provided by different manufacturers, these data may not accurately and reliably represent the actual service duration of the fan.

In the embodiments, in order to avoid the misjudgment caused by the user depending on the data provided by the manufacturer, after the predicted service duration of the target fan is obtained, the reference service duration of the target fan that is marked when leaving the factory is obtained, and then the reference service duration of the target fan is corrected with the predicted service duration of the target fan. It is conceivable that the method not only enables the user to accurately know the actual service duration of the target fan, but also helps the fan manufacturer to improve the product quality when the information is fed back to the fan manufacturer.

Reference is made to FIG. 7. FIG. 7 is a structural diagram of an abnormality early-warning apparatus for a fan provided by an embodiment of the present disclosure. The apparatus includes:

a data obtaining component 21 configured to obtain, when a target fan is capable of normally dissipating heat, a target rotational speed, a target operating current, and a target ambient temperature of the target fan at a current moment;

a first early-warning component 22 configured to provide, when the target rotational speed is less than a minimum rotational speed of the target fan, first early-warning information as a prompt;

a data prediction component 23 configured to predict, when the target rotational speed is greater than or equal to the minimum rotational speed of the target fan, a rotational speed and an operating current of the target fan at a next moment based on a rotational speed change curve, a current change curve, the target rotational speed, the target operating current, and the target ambient temperature to obtain a predicted rotational speed and a predicted operating current; and a second early-warning component 24 configured to provide, when the predicted rotational speed is less than a first preset threshold or the predicted operating current is greater than a second preset threshold, second early-warning information as a prompt, where the first preset threshold and the second preset threshold are numerical values set based on the IPC9591 standard.

The abnormality early-warning apparatus for a fan provided by the embodiment of the present disclosure has the beneficial effects of the abnormality early-warning method for a fan disclosed above.

Reference is made to FIG. 8. FIG. 8 is a structural diagram of an abnormality early-warning device for a fan provided by an embodiment of the present disclosure. The device includes:

a memory 31 configured to store a computer-readable instruction; and one or more processors 32 configured to implement the steps of the abnormality early-warning method for a fan disclosed above when executing the computer-readable instruction.

The abnormality early-warning device for a fan provided by the embodiment of the present disclosure has the beneficial effects of the abnormality early-warning method for a fan disclosed above.

Correspondingly, an embodiment of the present disclosure further provides a non-volatile computer-readable storage medium storing a computer-readable instruction, where the computer-readable instruction, when executed by one or more processors, may implement the steps of the abnormality early-warning method for a fan according to any one of the above embodiments.

The computer-readable storage medium provided by the embodiment of the present disclosure has the beneficial effects of the abnormality early-warning method for a fan disclosed above.

Herein, the embodiments are described progressively. Each embodiment focuses on the differences from other embodiments. The same or similar parts in the embodiments may be referred to each other. The apparatuses disclosed in the embodiments are described more simply because they correspond to the methods disclosed in the embodiments. Related parts may refer to the description of the method part.

Finally, it should be noted that herein, the relational terms such as first and second are only used to distinguish one entity or operation from another entity or operation, and do not necessarily require or imply any such actual relationship or order among these entities or operations. Moreover, the term "include/comprise", "contain", or any other variant thereof is intended to cover a non-exclusive inclusion, such that a process, method, material or device including a series of elements includes not only those elements but also other elements not expressly listed, or further includes elements inherent to such process, method, material or device. Without further limitation, the element defined by the statement "includes one . . . " does not preclude the presence of other identical elements in the process, method, item, or device including the elements.

Those of ordinary skill in the art may understand that all or some of the processes in the method of the above embodiment may be implemented by a computer-readable instruction instructing relevant hardware. The computer-readable instruction may be stored in a non-volatile computer-readable storage medium, and when the computer-readable instruction is executed, the processes of the above method embodiments may be included. Any reference to a memory, a storage, a database, or other media used in the various embodiments provided by this disclosure may include a non-volatile and/or volatile memory. The non-volatile memory may include a read-only memory (ROM), a programmable ROM (PROM), an electrically programmable ROM (EPROM), an electrically erasable programmable ROM (EEPROM), or a flash memory. The volatile memory may include a random access memory (RAM) or an external cache memory. As an explanation rather than a limitation, the RAM is obtainable in various forms, such as a static RAM (SRAM), a dynamic RAM (DRAM), a synchronous DRAM (SDRAM), a dual data rate SDRAM (DDRSDRAM), an enhanced SDRAM (ESDRAM), a synchlink DRAM (SLDRAM), a rambus direct RAM (RDRAM), a direct rambus dynamic RAM (DRDRAM), and a rambus dynamic RAM (RDRAM).

The technical features of the above embodiments may be combined arbitrarily. For the sake of brevity, all possible combinations of the technical features in the above embodiments are not described. However, the combinations of these technical features should be considered to be within the scope of this specification as long as there is no contradiction between them.

The above embodiments only express several implementations of this disclosure and are described more specifically and detailedly, but they should not be construed as a limitation to the scope of patent of the invention. It should be pointed out that several modifications and improvements may also be made by those of ordinary skill in the art without departing from the conception of this disclosure, and all fall within the scope of protection of this disclosure. Therefore, the scope of patent protection of the present disclosure should be determined by the appended claims.

What is claimed is:

1. An abnormality early-warning method for a fan, comprising:

when a target fan is capable of normally dissipating heat, obtaining a target rotational speed, a target operating current, and a target ambient temperature of the target fan at a current moment;

when the target rotational speed is less than a minimum rotational speed of the target fan, providing first early-warning information as a prompt;

when the target rotational speed is greater than or equal to the minimum rotational speed of the target fan, predicting a rotational speed and an operating current of the target fan at a next moment based on a rotational speed change curve, a current change curve, the target rotational speed, the target operating current, and the target ambient temperature to obtain a predicted rotational speed and a predicted operating current; and when the predicted rotational speed is less than a first preset threshold or the predicted operating current is greater than a second preset threshold, providing second early-warning information as a prompt, wherein the first preset threshold and the second preset threshold are numerical values set based on the Institute of Printed Circuits (IPC) standard.

2. The abnormality early-warning method for the fan as claimed in claim 1, wherein the process of obtaining the target rotational speed, the target operating current, and the target ambient temperature of the target fan at the current moment comprises:

obtaining the target rotational speed, the target operating current, and the target ambient temperature of the target fan at the current moment by using a baseboard management controller (BMC).

3. The abnormality early-warning method for the fan as claim 1, wherein the process of obtaining the rotational speed change curve and the current change curve comprises:

obtaining historical rotational speeds and historical operating currents of the target fan at different ambient temperatures, and obtaining rotational speed change rates and operating current change rates of the target fan that are changed with time at the different ambient temperatures respectively based on the historical rotational speeds and the historical operating currents, to obtain the rotational speed change curve and the current change curve.

4. The abnormality early-warning method for the fan as claimed in claim 3, wherein the process of obtaining historical rotational speeds and historical operating currents of the target fan at different ambient temperatures, and obtaining rotational speed change rates and operating current change rates of the target fan that are changed with time at the different ambient temperatures respectively based on the historical rotational speeds and the historical operating currents comprises:

monitoring rotational speeds and operating currents of the target fan at different ambient temperatures;

storing the rotational speeds and the operating currents of the target fan in a first storage area, and determining rotational speed changes and operating current changes of the target fan that are changed with time at the different ambient temperatures based on the rotational speeds and the operating currents of the target fan, to obtain a first data set;

storing the first data set in a third storage area;

when a duration at which data is stored in the first storage area reaches a preset duration threshold, storing the rotational speeds and the operating currents of the target fan in a second storage area, and determining rotational speed changes and operating current changes of the target fan that are changed with time at the different ambient temperatures based on the rotational speeds and the operating currents of the target fan, to obtain a second data set;

storing the second data set in the third storage area;

when all data in the first data set is written into the third storage area, clearing the data in the first storage area, and when all data in the second data set is written into the third storage area, clearing data in the second storage area;

when a duration at which the data is stored in the second storage area reaches the preset duration threshold, repeatedly performing the step of storing the rotational speeds and the operating currents of the target fan in a first storage area, and determining rotational speed changes and operating current changes of the target fan that are changed with time at the different ambient temperatures based on the rotational speeds and the operating currents of the target fan, to obtain a first data set; and when an amount of the data stored in the third storage area reaches a preset storage amount, obtaining the rotational speed change rates and the operating current change rates of the target fan that are changed with the time at the different ambient temperatures based on all the data in the third storage area.

5. The abnormality early-warning method for the fan as claimed in claim 4, wherein the process of determining rotational speed changes and operating current changes of the target fan that are changed with time at the different ambient temperatures based on the rotational speeds and the operating currents of the target fan comprises:

sending the rotational speeds and the operating currents of the target fan to a target logic operation chip, and determining the rotational speed changes and the operating current changes of the target fan that are changed with the time at the different ambient temperatures by using the target logic operation chip.

6. The abnormality early-warning method for the fan as claimed in claim 5, wherein the target logic operation chip comprises:

a microcontroller unit (MCU) or a digital signal processor (DSP).

7. The abnormality early-warning method for the fan as claimed in claim 4, wherein the rotational speed changes are obtained by calculating a difference between rotational speed upper limits or lower limits of the target fan at different moments.

8. The abnormality early-warning method for the fan as claimed in claim 1, further comprising:

predicting a service life of the target fan based on the rotational speed change curve, the current change curve, the target rotational speed, the target operating current, and the target ambient temperature to obtain a predicted service duration.

9. The abnormality early-warning method for the fan as claimed in claim 8, wherein the process of predicting the service life of the target fan based on the rotational speed change curve, the current change curve, the target rotational speed, the target operating current, and the target ambient temperature to obtain the predicted service duration comprises:

determining an initial rotational speed of the target fan in an initial operating state based on the rotational speed change curve, and determining the rotational speed of the target fan at the next moment based on the rotational speed change curve, the target ambient temperature, and the target rotational speed, to obtain the predicted rotational speed;

when the predicted rotational speed reaches the first preset threshold, obtaining an operating duration of the target fan when operating from the initial rotational speed to the first preset threshold, to obtain a first service duration;

determining an initial operating current of the target fan in the initial state based on the current change curve, and determining the operating current of the target fan at the next moment based on the current change curve, the target ambient temperature, and the target operating current, to obtain the predicted operating current;

when the predicted operating current reaches the second preset threshold, obtaining an operating duration of the target fan when operating from the initial operating current to the second preset threshold, to obtain a second service duration; and determining a shorter one of the first service duration and the second service duration as the predicted service duration.

10. The abnormality early-warning method for the fan as claimed in claim 8, further comprising:

obtaining a service duration of the target fan that is marked when leaving the factory, to obtain a reference service duration; and correcting the reference service duration with the predicted service duration.

11. The abnormality early-warning method for the fan as claimed in claim 1, wherein the operating current changes are obtained by calculating a difference between rotational speed upper limits or lower limits of the target fan at different moments.

12. The abnormality early-warning method for the fan as claimed in claim 1, wherein the rotational speed change curve is determined by the following:

measuring rotational speeds of the target fan at different ambient temperatures within a preset time period when the target fan starts to operate from a initial state;

plotting measured rotational speeds and ambient temperatures corresponding to the measured rotational speeds to obtain a first relation curve graph about corresponding changes of the target fan with operating duration, and taking the first relation curve graph as the rotational speed change curve of the target fan.

13. The abnormality early-warning method for the fan as claimed in claim 1, wherein the current change curve is determined by the following:

measuring operating currents of the target fan at different ambient temperatures within a preset time period when the target fan starts to operate from a initial state;

plotting measured operating currents and ambient temperatures corresponding to the measured operating currents to obtain a second relation curve graph about corresponding changes of the target fan with operating duration, and taking the second relation curve graph as the rotational speed change curve of the target fan.

14. An abnormality early-warning device for a fan, the device comprising a non-transitory computer-readable medium that comprises a memory, and one or more processors, wherein the memory stores a computer-readable instruction which, when executed by the one or more processors, causes the one or more processors to:

when a target fan is capable of normally dissipating heat, obtain a target rotational speed, a target operating current, and a target ambient temperature of the target fan at a current moment;

when the target rotational speed is less than a minimum rotational speed of the target fan, provide first early-warning information as a prompt;

when the target rotational speed is greater than or equal to the minimum rotational speed of the target fan, predict a rotational speed and an operating current of the target fan at a next moment based on a rotational speed change curve, a current change curve, the target rotational speed, the target operating current, and the target ambient temperature to obtain a predicted rotational speed and a predicted operating current; and when the predicted rotational speed is less than a first preset threshold or the predicted operating current is greater than a second preset threshold, provide second early-warning information as a prompt, wherein the first preset threshold and the second preset threshold are numerical values set based on the Institute of Printed Circuits (IPC) standard.

15. The abnormality early-warning device for the fan as claimed in claim 14, the computer-readable instruction further causes the one or more processors to:

obtain the target rotational speed, the target operating current, and the target ambient temperature of the target fan at the current moment by using a baseboard management controller (BMC).

16. The abnormality early-warning device for the fan as claimed in claim 14, the computer-readable instruction further causes the one or more processors to:

obtain historical rotational speeds and historical operating currents of the target fan at different ambient temperatures, and obtain rotational speed change rates and operating current change rates of the target fan that are changed with time at the different ambient temperatures respectively based on the historical rotational speeds and the historical operating currents, to obtain the rotational speed change curve and the current change curve.

17. The abnormality early-warning device for the fan as claimed in claim 16, wherein the computer-readable instruction further causes the one or more processors to:

monitor rotational speeds and operating currents of the target fan at different ambient temperatures;

store the rotational speeds and the operating currents of the target fan in a first storage area, and determine rotational speed changes and operating current changes of the target fan that are changed with time at the different ambient temperatures based on the rotational speeds and the operating currents of the target fan, to obtain a first data set;

store the first data set in a third storage area;

when a duration at which data is stored in the first storage area reaches a preset duration threshold, store the rotational speeds and the operating currents of the target fan in a second storage area, and determine rotational speed changes and operating current changes of the target fan that are changed with time at the different ambient temperatures based on the rotational speeds and the operating currents of the target fan, to obtain a second data set;

store the second data set in the third storage area;

when all data in the first data set is written into the third storage area, clear the data in the first storage area, and when all data in the second data set is written into the third storage area, clear data in the second storage area;

when a duration at which the data is stored in the second storage area reaches the preset duration threshold, repeatedly perform the step of storing the rotational speeds and the operating currents of the target fan in a first storage area, and determining rotational speed changes and operating current changes of the target fan that are changed with time at the different ambient temperatures based on the rotational speeds and the operating currents of the target fan, to obtain a first data set; and when an amount of the data stored in the third storage area reaches a preset storage amount, obtain the rotational speed change rates and the operating current change rates of the target fan that are changed with the time at the different ambient temperatures based on all the data in the third storage area.

18. The abnormality early-warning device for the fan as claimed in claim 17, wherein the computer-readable instruction further causes the one or more processors to:

send the rotational speeds and the operating currents of the target fan to a target logic operation chip, and determine the rotational speed changes and the operating current changes of the target fan that are changed with the time at the different ambient temperatures by using the target logic operation chip.

19. One or more non-transitory computer-readable storage media storing computer-readable instructions, wherein the computer-readable instructions, when executed by one or more processors, cause the one or more processors to:

when a target fan is capable of normally dissipating heat, obtain a target rotational speed, a target operating current, and a target ambient temperature of the target fan at a current moment;

when the target rotational speed is less than a minimum rotational speed of the target fan, provide first early-warning information as a prompt;

when the target rotational speed is greater than or equal to the minimum rotational speed of the target fan, predict a rotational speed and an operating current of the target fan at a next moment based on a rotational speed change curve, a current change curve, the target rotational speed, the target operating current, and the target ambient temperature to obtain a predicted rotational speed and a predicted operating current; and when the predicted rotational speed is less than a first preset threshold or the predicted operating current is greater than a second preset threshold, provide second early-warning information as a prompt, wherein the first preset threshold and the second preset threshold are numerical values set based on the Institute of Printed Circuits (IPC) standard.

20. The one or more non-transitory computer-readable storage media as claimed in claim 19, wherein the computer-readable instructions further cause the one or more processors to:

obtain the target rotational speed, the target operating current, and the target ambient temperature of the target fan at the current moment by using a baseboard management controller (BMC).

* * * * *